US008261654B2

(12) United States Patent
Dreher et al.

(10) Patent No.: US 8,261,654 B2
(45) Date of Patent: Sep. 11, 2012

(54) AXIAL PISTON MACHINE HAVING SWIVEL CRADLE ACTUATING PISTONS AND DISPLACEMENT LIMITING DEVICES

(75) Inventors: Herbert Dreher, Horb (DE); Clemens Krebs, Tuebingen (DE)

(73) Assignee: Robert Bosch GmbH, Stuttgart (DE)

( * ) Notice: Subject to any disclaimer, the term of this patent is extended or adjusted under 35 U.S.C. 154(b) by 383 days.

(21) Appl. No.: 12/599,383

(22) PCT Filed: May 14, 2008

(86) PCT No.: PCT/EP2008/003868

§ 371 (c)(1),
(2), (4) Date: Nov. 9, 2009

(87) PCT Pub. No.: WO2008/138604

PCT Pub. Date: Nov. 20, 2008

(65) Prior Publication Data

US 2010/0307330 A1 Dec. 9, 2010

(30) Foreign Application Priority Data

May 14, 2007 (DE) ..... 10 2007 022 567

(51) Int. Cl.
*F01B 3/02* (2006.01)

(52) U.S. Cl. ..... 91/506; 92/12.2

(58) Field of Classification Search ..... 417/222.1; 91/505, 506; 92/12.2, 71, 13.7, 13.5
See application file for complete search history.

(56) References Cited

U.S. PATENT DOCUMENTS 1,573,525 A * 2/1926 Sandoz ..... 91/503
1,749,682 A * 3/1930 Weldy ..... 417/270
2,455,062 A 11/1948 Ifield
3,274,948 A * 9/1966 Baits ..... 91/506
3,373,696 A * 3/1968 Geyer ..... 91/499
3,612,725 A * 10/1971 Spence ..... 417/203
3,830,593 A * 8/1974 Chanal ..... 417/203
3,830,594 A * 8/1974 Hein et al. ..... 417/217
4,142,452 A * 3/1979 Forster et al. ..... 91/506
4,168,653 A * 9/1979 Hein et al. ..... 91/506
5,251,537 A 10/1993 Hoshino et al.

FOREIGN PATENT DOCUMENTS

DE 26 20 523 A1 12/1977
DE 102 53 902 A1 7/2003
DE 10 2006 062 065 A1 7/2008

OTHER PUBLICATIONS

RDE 92500-19-L/11.03, Bosch Rexroth AG, Elchingen, Germany.

* cited by examiner

*Primary Examiner* — Devon Kramer
*Assistant Examiner* — Nathan Zollinger
(74) *Attorney, Agent, or Firm* — Scully, Scott, Murphy & Presser, P.C.

(57) ABSTRACT

An axial piston machine is provided, which has a swivel cradle, the inclination of which can be modified in relation to a rotational axis of a cylinder drum. A regulation system acts on the swivel cradle, which has a first regulator for adjusting the inclination of the swivel cradle in a first displacement direction and a second regulator for adjusting the inclination in an opposite second displacement direction. The first and second regulators are located on opposite sides of the swivel cradle in relation to the rotational axis. The axial piston machine also has a device for limiting the displacement of the swivel cradle, which has a first adjustable limiting device and a second adjustable limiting device, which each act on the swivel cradle and are located on opposite sides of the swivel cradle in relation to the rotational axis.

16 Claims, 4 Drawing Sheets

AXIAL PISTON MACHINE HAVING SWIVEL CRADLE ACTUATING PISTONS AND DISPLACEMENT LIMITING DEVICES

BACKGOURND

The invention relates to an axial piston machine with a swivel cradle, the inclination of which can be modified in relation to a rotational axis of a cylinder drum, and with an actuating system acting on the swivel cradle.

A hydrostatic piston machine, in which the stroke of a piston disposed within a cylinder drum can be modified by means of an swash plate, is known from U.S. Pat. No. 2,455,062. The housing for the accommodation of the drive shaft, the cylinder drum and the actuators of an actuating system acting on the inclination of the swash plate is designed to be substantially pot-shaped. In the region of the base of the pot, through-openings are provided, which are formed as pressure chambers and are closed in a sealed manner on the outside of the housing by means of closure caps. In each case the actuators comprise an actuating piston, which can be held on the side facing away from the pressure chamber in contact with the swash plate and can therefore incline the latter relative to the rotational axis.

The known hydrostatic machines have the disadvantage that the limitation of the inclination regulation of the swivel cradle or respectively of the swash plate is implemented directly via the actuating piston of the actuator.

Furthermore, it is known from an information document RDE 92800-19-L/11.03 of Bosch Rexroth AG that a first actuator and a second actuator can be provided in a housing of a variable displacement pump. The two actuators are disposed on opposite sides of the rotational axis of the variable displacement pump. The actuators act directly on the adjustable swivel cradle, the inclination of which relative to the rotational axis is limited by means of a first limiting device and a second limiting device. The limiting devices act directly on the swash plate and are arranged adjacent to the actuators and offset radially outwards. The two actuators and the two limiting devices are therefore disposed on a common plane extending through the rotational axis.

The arrangement of the adjustable limiting devices laterally alongside the actuators of the actuating system has the disadvantage that the structural space of the variable displacement pump known from RDE 92500-19-L/11.03 is increased.

The object of the present invention is therefore to provide an adjustable axial piston machine, which provides an actuating system optimised with regard to the utilisation of structural space.

SUMMARY

The axial piston machine according to the invention provides a swivel cradle, the inclination of which can be modified in relation to a rotational axis of a cylinder drum. An actuating system acts on the swivel cradle. The actuating system provides a first actuator for the adjustment of the inclination of the swivel cradle in a first displacement direction and a second actuator for the adjustment of the inclination of the swivel cradle in an opposing second displacement direction. The first and the second actuator are located on opposite sides of the axial piston machine in relation to the rotational axis and act on the swivel cradle. Furthermore, the actuating system of the axial piston machine provides a device for limiting the displacement of the swivel cradle. According to the invention, the device for limiting the displacement of the swivel cradle comprises a first adjustable limiting device and a second adjustable limiting device, each of which act on the swivel cradle and, like the first and second actuator, are each located on opposite sides of the swivel cradle in relation to the rotational axis. In this context, the first and the second actuator and the first and the second limiting device are each located in different regions of the axial piston machine. With a housing of conventionally approximately rectangular cross-section, the two limiting devices are therefore approximately on a first diagonal, and the two actuators are disposed on the other diagonal. Accordingly, it is not necessary, to arrange the limiting device radially outwards, starting from the rotational axis, alongside the actuator. As a result, the structure of the axial piston machine according to the invention is slimmer.

The swivel axis of the swivel cradle and the rotational axis are preferably perpendicular to one another, wherein the first actuator and/or the second actuator are disposed in each case in a plane arranged parallel to the rotational axis. In this case, it is particularly advantageous, if the first actuator and the adjustable first limiting device limiting the displacement of the swivel cradle in the first displacement direction are arranged in a common plane. The surface normal of this common plane is arranged parallel to the swivel axis. At the same time or as an alternative to this, the adjustable second limiting device limiting the displacement of the swivel cradle in the second displacement direction is arranged in a further plane, of which the surface normal also extends parallel to the swivel axis of the swivel cradle and in which the second actuator is also arranged. This arrangement has the advantage that the application of the actuating force by the first actuator and, in the opposite direction, of the limiting force by the first limiting device both take place in one plane. Since this plane is disposed perpendicular to the swivel axis of the swivel cradle, a good application of force is achieved and, in particular, rotational forces on the swivel cradle, which could cause a rotary displacement about a displacement axis different from the swivel axis, are avoided. The same applies for the application of forces by the second actuator and the corresponding adjustable second limiting device.

The first actuator and/or the second actuator preferably provide in each case an actuating piston for the generation of the actuating force. These can be supplied with an actuating pressure in a simple manner in a pressure chamber. A simple actuating system without the use of additional, for example, electrical actuators can therefore be realised. The actuating force generated by an actuating pressure can therefore be transferred directly to the swivel cradle or a component built onto the swivel cradle, such as a holding segment.

In this context, it is particularly advantageous if a blind borehole is provided in the housing of the axial piston machine in each case on a side opposite to the swivel cradle, in which the end of the actuating piston facing respectively away from the swivel cradle is arranged. A pressure chamber is formed between the housing or respectively the blind borehole arranged therein and the actuating piston. The pressure in this pressure chamber therefore directly determines the actuating force, which is finally used for adjusting the inclination of the swivel cradle.

The end of the actuating piston directed towards the swivel cradle does not perform a purely linear displacement. Through the swivel displacement of the swivel cradle, a displacement of the actuating piston in one plane is achieved. The end of the actuating piston provided in the blind borehole is therefore preferably designed as a crowned actuating-piston disc. A crowned actuating piston disc of this kind provides the advantage that the slight tilting movements, which the actuating piston performs in the blind borehole can be per-formed without loss of the sealing effect of the actuating-piston disc in the blind borehole.

The actuating forces, which cause a swivel displacement of the swivel cradle, preferably engage on a holding segment, which is connected to the swivel cradle. Accordingly, the actuating piston transfers its actuating force via the holding segment to the swivel cradle.

For the connection of the actuating piston to the swivel cradle or respectively to the holding segment, a spherical head connection, which is partially relieved in a hydrostatic, lubricated manner, is preferably provided. With a hydrostatically partially relieved spherical head connection, a high reproducibility of the actuating displacement is guaranteed. The frictional forces occurring between the actuating piston and the swivel cradle or respectively the holding segment are reduced by the hydrostatic relief. In this context, a locked spherical head connection, through which both tensile forces and also compressive forces can be transferred, is provided. A formation of this kind guarantees a particularly low-play connection and therefore increases the precision of the regulation.

With the use of holding segments, it is particularly preferred to provide on each of the holding segments a stopping surface, which cooperates with the corresponding first or second limiting device in limiting the displacement of the swivel cradle in the displacement direction specified by the allocated actuator. This means that, for example, a displacement of the swivel cradle in the first displacement direction is caused by the first actuator. The limiting element limiting the displacement in this displacement direction cooperates with a stopping surface provided for this purpose on the holding segment. Accordingly, the actuating force and the counter-force limiting the further adjustment in this displacement direction are active on the same holding segment, when the stopping surface is in contact with the adjustable limiting element. In particular, together with the arrangement of the adjustable limiting device and the actuator in a plane formed parallel to the rotational plane, an optimised flow of force through the holding segment or respectively the swivel cradle is therefore guaranteed. This is the case in particular, if the plane, in which the actuator and the corresponding, allocated limiting device, extends through a bearing region of the spherical swivel-angle bearing of the swivel cradle.

Moreover, it is preferred that, in addition to the stopping surface, a further stopping surface is formed on each holding segment, which cooperates with a counter element of the housing as a safety stop. Accordingly, for each displacement direction, an adjustable swivel-angle stop and a structurally-determined safety stop are provided. The adjustable swivel-angle stop is formed by the adjustable first or respectively second limiting device and the respective stopping surfaces of the holding segments. For example, in the event of an accidental adjustment of the adjustable limiting devices, the safety stop engages for the protection of the axial piston machine. The counter element or respectively the counter elements, which cooperate with the further stopping surfaces, are preferably provided on a flange part of the housing or in the casing region of a pot-shaped housing part.

The first actuator preferably provides a first actuating piston, in which a lubricant channel is provided. As an alternative or in addition to this, the second actuator provides a second actuating piston, in which a lubricant channel is formed. This lubricant channel connects the allocated blind borehole, in which the one end of the actuating piston is arranged in a pressure chamber, to the end of the actuating piston facing towards the swivel cradle. In this manner, through the pressure in the pressure chamber, which impinges with a hydraulic force on the first or respectively the second actuating piston, the pressure medium is removed for the hydrostatic relief of the spherical head connection.

By preference, the swivel cradle provides a swivel-cradle bearing, which is arranged in a rotatable manner in a corresponding bearing surface on the side of the housing. The swivel-cradle bearing comprises two bearing surfaces. The common centre line of these bearing surfaces defines the swivel axis of the swivel cradle. Pressure medium channels are preferably formed in the swivel cradle, through which pressure medium supplied from the blind borehole of at least one of the actuators is guided for the hydrostatic relief of the bearing surface of the swivel cradle. Furthermore, with the use of a holding segment, at least one corresponding channel is also formed in the holding segment. Via the channel system generated in this manner, pressure medium from the pressure chamber is guided via the actuating piston into the swivel cradle, where it emerges in the region of the bearing surface or respectively of several bearing surfaces of the swivel cradle and ensures the hydrostatic relief there. The pressure medium is preferably removed from the actuator for swivelling open, that is to say for actuating the axial piston machine in the direction of increasing stroke volume. The connection to both bearing surfaces of the swivel cradle is then itself arranged in the swivel cradle. The pressure-medium channel branches there and, in this manner, connects the two bearing surfaces with the open-swivelling actuator.

Starting from a neutral position, in which the surface normal of a running surface of the swivel cradle extends parallel to the rotational axis, the swivel cradle can preferably be swivelled in two opposite directions. In this context, the maximum swivel in the two opposite directions is preferably of the same magnitude and can be limited in each case by the formation of a safety stop. The adjustable first and second limiting devices are provided in order to allow a different limiting of the swivel angle in the first and/or the second displacement direction.

The first and/or the second actuator preferably provide an elastic element, which supplies the swivel cradle with a force acting in the first displacement direction and/or with a force acting in the second displacement direction. With the provision of only one elastic element, for example, on the first actuator, the axial piston machine can be adjusted to a maximum stroke volume for one flow direction. Accordingly, before putting into operation, an axial piston machine designed, for example, as a pump, is adjusted to its maximum displacement volume.

The elastic element is preferably a steel spring designed as a spiral spring, which surrounds the actuating piston of the first or the second actuator, wherein the spiral spring is supported in a spring retainer at the housing end. The spring retainer according to one further preferred embodiment is disposed either on a base of a pot-shaped housing part or is disposed in an alternative embodiment on a contact ring, which is arranged at a spacing distance from the base of the pot-shaped housing part in the housing of the axial piston machine.

BRIEF DESCRIPTION OF THE DRAWINGS

The invention is explained in greater detail below with reference to the drawings. The drawings are as follows.

DETAILED DESCRIPTION OF EXEMPLARY EMBODIMENTS

Figure 1:
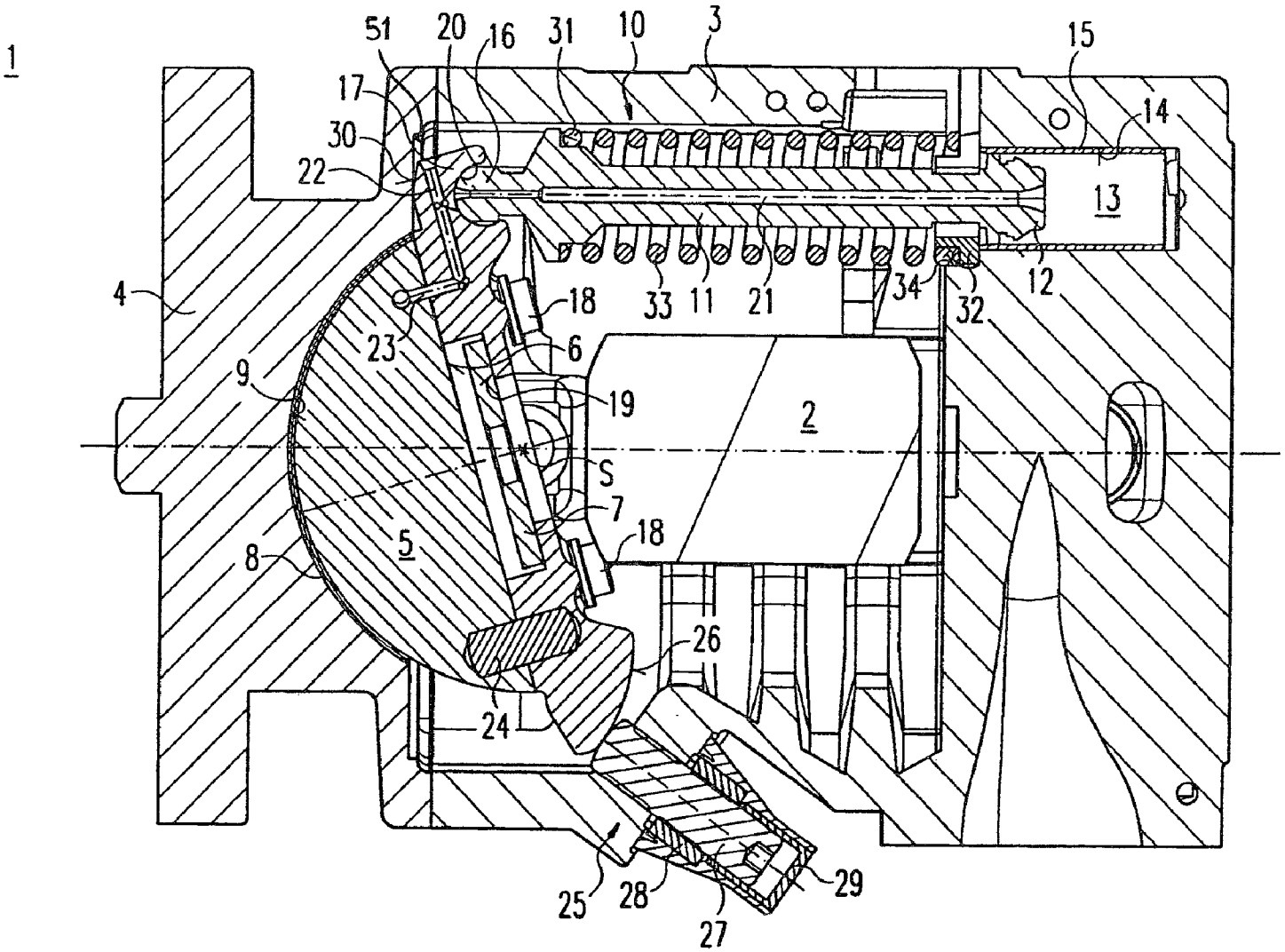
FIG. 1 shows a longitudinal section through a first exemplary embodiment of an axial piston machine according to the invention without feedback of the adjusted displacement volume.

FIG. 1 shows a sectional presentation of an axial piston machine 1 according to the invention, wherein the sectional plane extends in a parallel but eccentric manner relative to a rotational axis of the axial piston machine 1. The axial piston machine 1 provides a cylinder drum 2, in which several cylindrical boreholes are arranged distributed around a peripheral circle, although this is not illustrated. Pistons, which pump a pressure medium through their stroke displacement, if the illustrated axial piston machine 1 is a pump, are arranged in a longitudinally displaceable manner within the cylindrical boreholes.

The axial piston machine 1 provides a housing, which consists of a first pot-shaped housing part 3 and a second housing part, which is formed as a flange part 4. A drive shaft, which is not recognisable in FIG. 1, is mounted within the flange part 4 and the first pot-shaped housing part 3 in a rotatable manner and connected in a rotationally-rigid manner to the cylinder drum 2. In the case of a rotation of the drive shaft, the cylinder drum 2 is set into rotation by the rotationally-rigid connection. The longitudinally displaceable pistons arranged within the cylinder drum 2 are supported in a known manner via sliding shoes on a swivel cradle 5. The swivel cradle 5 provides a running surface 6 for this purpose. In order to prevent a raising of the sliding shoe from the running surface 6 during a suction stroke, a pull-back plate 7 is provided. The pull-back plate 7 is held at a fixed spacing distance from the running surface 6 of the swivel cradle 5 and therefore prevents a lifting of the sliding shoe from the running surface 6. To allow a rotational movement of the swivel cradle 5, the sliding shoes are connected to the pistons in an articulated manner. Dependent upon the inclination of the swivel cradle 5, the pistons therefore perform within the cylinder drum 2 a differently sized stroke per rotation of the drive shaft or respectively of the cylinder drum 2.

On its side facing towards the flange part 4, the swivel cradle 5 provides a swivel-cradle bearing 8. For this purpose, at least one first bearing region is formed on the swivel cradle 5, which, with a corresponding recess 9 of the flange part 4, provides a sliding bearing. The formation of the swivel-angle bearing of the swivel cradle 5 is explained in greater detail below with reference to FIGS. 2 and 5.

The swivel cradle 5 is rotatable about the swivel axis S by rotation of the swivel cradle 5 in the swivel-cradle bearing. Accordingly, the inclination of the running surface 6 relative to the rotational axis of the cylinder drum 2 is modified.

For the adjustment of the inclination of the swivel cradle 5 and therefore of the stroke of the pistons in the cylinder drum 2 during a rotation of the cylinder drum 2, an actuating system is provided within the housing of the axial piston machine 1. The actuating system comprises at least one first actuator 10. The first actuator 10 provides a first actuating piston 11. The first actuating piston 11 limits a pressure chamber 13 with its first end 12. The pressure chamber 13 is formed in a base of the pot-shaped housing part 3. For the formation of the pressure chamber 13, a blind borehole 14 is introduced into the base of the pot-shaped housing part 3, into which a bush 15 is inserted. The bush 15 is preferably pressed into the blind borehole 14. The internal wall of the bush 15 serves the first end 12 of the actuating piston 11 as a sliding surface and cooperates with the first end 12 of the first actuating piston 11 in a sealing manner. The first end 12 of the actuating piston 11 is not formed in a cylindrical manner, but provides a slightly crowned shape in order to prevent a jamming in the bush 15 in the case of an inclined position of the actuating piston 11 relative to the longitudinal axis of the bush 15. In the crowned region of the first end 12 of the actuating piston 11, a sealing ring could also be provided.

A spherical head is formed at a second end 16 of the actuating piston 11 facing away from the first end 12. The spherical head is connected to a holding segment 17 in such a manner that both tensile and compressive forces can be transferred. The holding segment 17 is connected to the swivel cradle 5 by means of screws. The holding segment 17 is screwed onto the running surface 6 in an external region of the swivel cradle 5. Moreover, the holding segment 17 provides a holding surface 19, which engages over the pull-back plate 7 and is in contact with the pull-back plate 7 and accordingly ensures a constant spacing distance of the pull-back plate 7 from the running surface 6 of the swivel cradle 5.

To fix the spherical-headed second end 16 of the actuating piston 11, a spherical recess 20, which encloses the spherical-headed second end 16 of the actuating piston 11, is provided in the holding segment 17. The connection of the actuating piston 11 to the holding segment 17 is designed as a locked connection. That is to say, the spherical-headed second end 16 is enclosed by the spherical recess of the holding segment further than up to the equator.

In the interior of the actuating piston 11 in the first actuator 10, a lubricant channel 21 is formed. The lubricant channel 21 extends from the first end 12 of the actuating piston 11 to the second end 16. Accordingly, the lubricant channel 21 connects the pressure chamber 13 to the spherical-headed second end 16 of the actuating piston 11. A pressure predominating in the pressure chamber 13 therefore ensures an output of pressure medium at the spherical-headed second end 16 of the actuating piston 11. Accordingly, the articulated connection between the actuating piston 11 and the holding segment 17 is lubricated and hydrostatically relieved.

In FIG. 1, let it be assumed that the first actuator 10 is provided for swivelling the axial piston machine 1 open in the direction of the maximum displacement volume. For this purpose, the pressure chamber 13 is connected to the pumping end of the axial piston machine 1 designed as a pump. The positive pressure disposed in the pressure chamber 13 is furthermore utilised in order to achieve a hydrostatic relief of the swivel cradle 5 in the flange part 4. For this purpose, a pressure medium channel 22 and respectively 23 is formed both in the holding segment 17 and also in the swivel cradle 5. In a manner which is not illustrated, the pressure medium channel 23 of the swivel cradle 5 is connected outside the section with the bearing region 8 illustrated in FIG. 1. The pressure medium disposed under pressure and originating from the pressure chamber 13 accordingly emerges between the recess 9 and the bearing region 8 of the swivel cradle 5 and therefore ensures a hydrostatic relief of the swivel cradle 5. This achieves a considerable reduction of the actuation forces required.

To allow a positioning of the holding segment 17 relative to the swivel cradle 5, an alignment pin 24, which is inserted into a borehole in the swivel cradle 5 and a corresponding borehole in the holding segment 17, is provided. Furthermore, in the region of an end of the holding segment 17 facing away from the ball-joint connection between the actuating piston 11 and the holding segment 17, an adjustable, first limiting device 25 is provided in the pot-shaped housing part 3. The first limiting device 25 cooperates with a first stopping surface 26, which is formed on the holding segment 17. The first stopping surface 26 is designed in a crowned manner, so that, independently of the setting of the first limiting device 25, the application of force by the limiting device 25 is implemented perpendicular to the first stopping surface 26 and therefore through the centre point of the crown. Viewed from the stopping surface, the centre point of this crown is disposed in the direction of the swivel cradle 5.

The first limiting device 25 comprises a setting screw 27, which is screwed into a thread in the housing borehole provided for this purpose. Dependent upon the depth of screwing in, the maximum deflection of the swivel cradle 5 in a first displacement direction is determined by the first limiting device 25. The housing borehole is arranged in the region of the casing of the pot-shaped housing part 3. It encloses an angle with the rotational axis such that the central axis of the setting screw 27 extends through the centre point of the crown of the stopping surface 26.

The first actuator 10, the first limiting device 25 and the first holding segment 17 are all allocated to a first displacement direction of the swivel cradle 5. While the first actuator 10 seeks to displace the swivel cradle 5 in a first displacement direction, the first limiting device 25 serves as an adjustable stop and accordingly limits the maximum displacement of this first displacement direction. A locking nut 28 is provided to secure the setting screw 27 in a selected position. At the same time, the locking nut 28 serves to seal the housing interior from the environment. A safety cap 29 prevents unauthorised modification of the set values.

To guarantee the consistent safety of the axial piston machine 1 even in the event of an accidental adjustment of the setting screw 27, a further stopping surface 30 is also formed at the same end of the holding segment 17, at which the ball-joint between the second end 16 of the actuating piston 11 and the first holding segment 17 is provided. The further stopping surface 30 is formed on the side facing towards the flange part 4 and cooperates with a counter element 51 of the flange part 4 as a safety stop. Accordingly, even if the setting screw 27 is completely unscrewed, a displacement can take place only up to the response of the safety stop.

In the case of a displacement of the axial piston machine 1 in the direction of maximal stroke volume, the safety stop is preferably formed between the flange part 4 and the further stopping surface 30 of the first holding segment 17.

As illustrated directly in FIG. 1, the first actuator 10 and the first limiting device 25, are arranged in a plane, which extends parallel to the rotational axis of the cylinder drum 2 and is disposed in particular perpendicular to the swivel axis S of the swivel cradle 5. The direction of the force both for the application of the actuating force by the first actuator 10 and also the direction of force in the case of a stopping against the adjustable first limiting device 25 is therefore also disposed in the plane formed parallel to the rotational axis. Since this plane at the same time extends through a first bearing region formed on the swivel cradle 5 and the flange part 4, torsional forces on the swivel cradle 5 are avoided.

In order to pre-tension the axial piston machine 1 in the direction of maximum displacement volume even with a depressurised pressure chamber 13, an elastic element is provided on the first actuator 10. The elastic element in the illustrated exemplary embodiment is designed as a spring 33. The spring 33, which is preferably a steel spiral spring, is supported at one end on a first spring bearing 31 formed in the proximity of the second end 16. The spring bearing 31 is formed as a radial shoulder in the actuating piston 11 and provides a guiding portion extending in the axial direction slightly in the direction towards the first end 12 of the actuating piston 11 for centring the spring 33. At the opposite end of the spring 33, the spring 33 is in contact with a second spring bearing 32. The spring bearing 32 also provides a guiding portion, which extends in the axial direction. The spring bearing 32 is arranged in a centring recess 34 of the housing part 3 and is in contact there on the base of the pot-shaped housing part 3. In this context, the spring bearing 32 is preferably disposed at the same time on the base of the pot-shaped housing 3 at the bottom of the centring recess 34 and on the end of the bush 15 orientated towards the interior of the housing of the axial piston machine 1.

FIG. 1 shows a section through the plane defined by the first actuator 10 and the first adjustable limiting device 25. The first actuator 10 is provided for the adjustment of the axial piston machine 1 in the direction of relatively larger stroke volume and can therefore also be described as an opening device. This is relevant, if the axial piston machine 1 is used as a hydro-pump, for example, in an open circuit, and is provided for pumping only in one direction.

Furthermore, a second actuator 35, which is, however, not visible in the view shown in FIG. 1 because of the position of the section, is provided in the axial piston machine 1. The second actuator 35 also provides a second variable limiting device 39 and corresponds substantially with the first actuator 10. The second actuator 35 and the second limiting device 39 are also once again arranged in a common plane, wherein this further plane is disposed parallel to the plane of the first actuator 10 and of the first limiting device 25. In this context, the two planes are preferably disposed symmetrically to the rotational axis of the cylinder drum 2.

Figure 2:
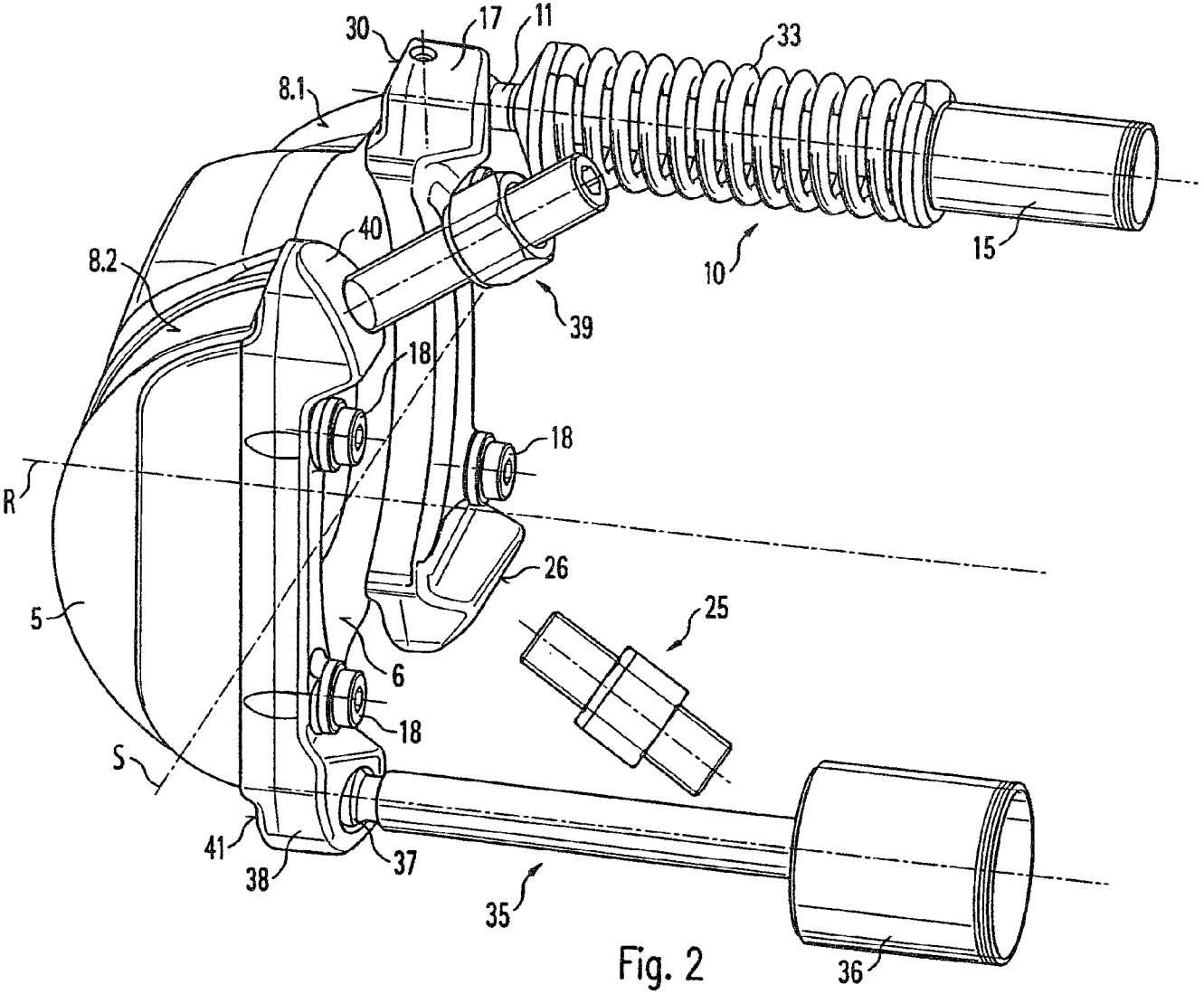
FIG. 2 shows a presentation of the substantial components of an actuating system of an axial piston machine according to the invention.

This arrangement is shown in FIG. 2, in which the individual components of the actuating system are illustrated once again in a perspective view. In this context, the components of the axial piston machine 1 not relating to the actuating system have been omitted for reasons of clarity.

It is evident that the first actuator 10 and the second actuator 35 are disposed on opposite sides in relation to the rotational axis. The second actuator 35 of the actuating system also provides an actuating piston, which is mounted with its first end in a second bush 36. The second bush 36 is also inserted in a blind borehole in the base of a pot-shaped housing part 3. Accordingly, a second pressure chamber is formed in the bush 36, which is closed by the base of the pot-shaped housing part 3, as in the case of the first actuator 10. The pressure cavity or the pressure chamber is limited by a similarly crowned actuating-piston disc. Over the common adjustment path of the actuating system, the respective crowned actuating-piston disc of the actuating piston 11 and also of the actuating piston of the second actuator 35 is guided in the bush 15 or respectively the further bush 36. A ball-joint connection is also formed at the other end of the actuating system of the second actuator 35. The second end 37 of the actuating piston of the second actuator 35 is also inserted in a spherical recess of a second holding segment 38. Like the first holding segment 17, the second holding segment 38 is connected to the swivel cradle 5 by means of screws 18. The first and the second holding segment 17 and 38 are preferably designed in an identical manner. The first holding segment 17 extends substantially along the plane, in which the first actuator 10 and the first limiting device 25 are arranged. Correspondingly, the second holding segment 38 extends substantially along a further plane, in which the second actuator 35 and a second variable limiting device 39 are arranged. The second variable limiting device 39 corresponds in its structure to the first variable limiting device 35, and a repetition of the description is therefore not required.

With regard to a cross-section through the axial piston machine 1, which typically provides a housing with a rectangular or square cross-section, the actuators 10 and 35 are arranged on a first diagonal in the region of the internal corners of the housing, and the second adjustable limiting devices 25 and 39 are arranged on a second diagonal of the internal corners of the housing. With regard to a section of this kind, if the axial piston machine is subdivided into four quadrants, the first actuator 10 is arranged in the first quadrant, the first limiting device 25 in the fourth quadrant, the second actuator 35 in the third quadrant and the second adjustable limiting device 39 in the second quadrant.

A stopping surface 40, which is also designed in a crowned manner, is also formed on the second holding segment 38. As with the first holding segment 17, the crowned formation of the stopping surface 40 has the consequence that, independently of the selected setting of the variable limiting device 39, the application of force is always disposed perpendicular to the stopping surface 40. To provide a safety stop, a further stopping surface 41 is also formed on the second holding segment 38. The further stopping surface 41 is formed at the same end of the second holding segment 38, as the ball-joint connection with the actuating piston of the second actuator 35.

In FIG. 2, it is evident that the swivel-cradle bearing 8 of the swivel cradle 5 is formed by a first bearing surface 8.1 and a second bearing surface 8.2. In this context, the first bearing surface 8.1 extends with a width in the direction of the swivel axis S, such that the plane, in which the first actuator 10 and the first adjustable limiting device 25 are arranged, that is to say, in which the directions of force through the first actuator 10 and the first adjustable limiting device 25 are disposed, extends through the first bearing surface 8.1. In a corresponding manner, the second bearing surface 8.2 also extends over a width in the direction of the swivel axis S, such that the further plane, in which the second actuator 35 and the second limiting device 39 are arranged, extends through the region of the second bearing surface 8.2.

Figure 3:
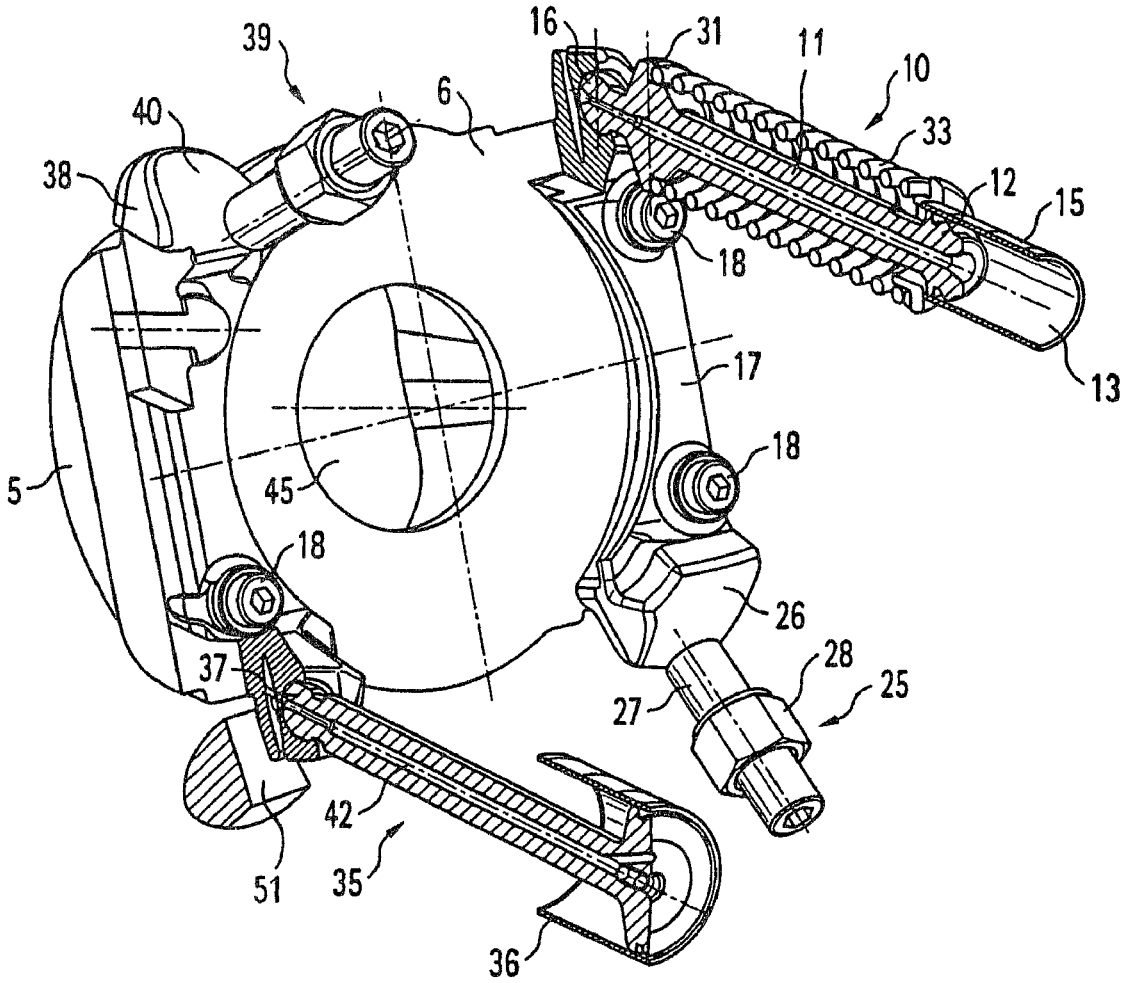
FIG. 3 shows a second presentation of the actuating system from FIG. 2.

FIG. 3 presents another perspective view of the actuating system of the axial piston machine 1 according to the invention. In this context, in particular, the first actuator 10 and the second actuator 35 are illustrated in a section. Furthermore, in the case of the second actuator 35, a counter element to the first stopping surface 40 is shown. In particular, in the case of a return swivel device, this counter element to the second stopping surface 40, which cooperates with the second stopping surface 40 as a safety stop, can also be formed on the pot-shaped housing part 3. In the sectional view of the second actuator 35, it is evident that a lubricant channel 42 extending in the longitudinal direction is also provided in the actuating piston of the second actuator 35. This lubricant channel 42 connects the second pressure chamber formed in the second bush 36 with the ball-joint connection between the actuating piston and the second holding segment 38.

It is clearly evident from FIG. 3, that the first pressure chamber 13 is designed to be smaller in diameter than the first pressure chamber. As a result, in the case of a pump, it is always possible to have the pump-end positive pressure of the axial piston machine 1 present in the first pressure chamber 13. A swivelling in the direction of decreasing pumping volumes takes place when corresponding actuating pressures are reached in the second pressure chamber of the actuating piston of the second actuator 35. In FIG. 3, the actuating system is presented in its first terminal position, in which the stopping surface 26 of the first holding segment 17 is disposed in contact with the first limiting device 25. Furthermore, it is evident that the swivel cradle 5 is perforated centrally by a borehole 45. This borehole 45 forms a passage for the drive shaft of the axial piston machine 1.

Figure 4:
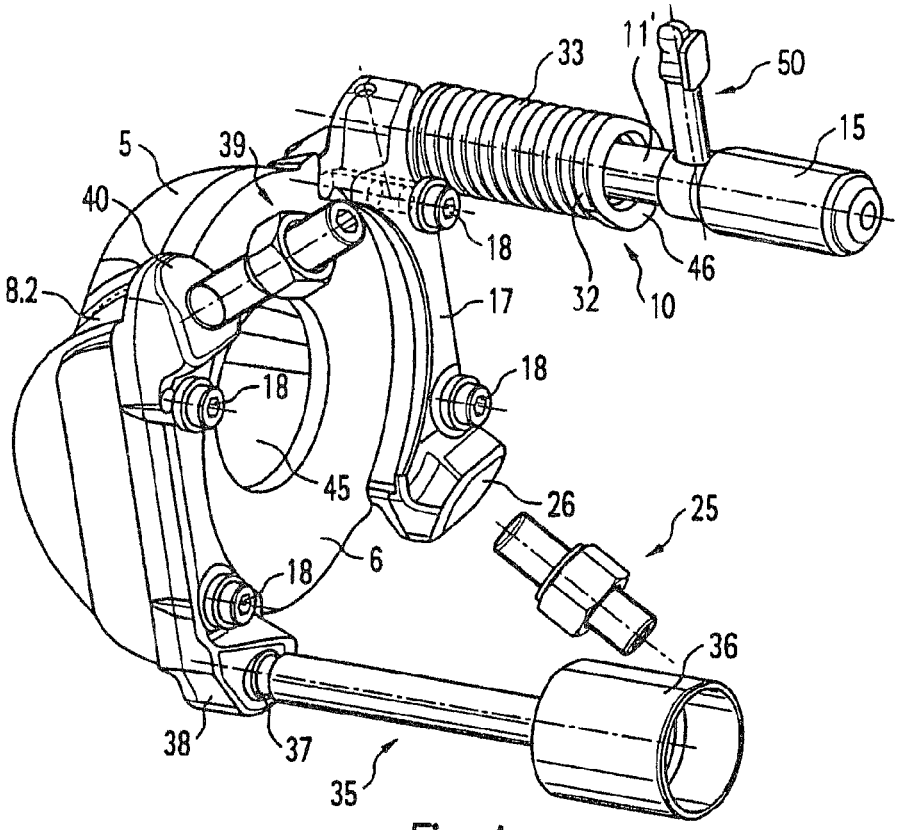
FIG. 4 shows a presentation of the substantial components of an actuating system for the axial piston machine according to the invention with feedback of the adjusted position of the swivel cradle.

In FIG. 4, a slightly modified exemplary embodiment of the actuating system of the axial piston machine 1 according to the invention is presented. By contrast with the actuating systems presented in FIGS. 1 to 3, a feedback of the position of the swivel cradle 5 and accordingly of the actuating piston 11' of the first actuator is possible. For this purpose, a feedback element 50 is arranged on the actuating piston 11'. This feedback element 50 is firmly connected to the actuating piston 11', so that the position of the feedback element 50 provides information regarding the respectively set pumping quantity of the axial piston machine 1. In particular, a feedback element 50 of this kind is advantageous for a swivel angle control or output control of the axial piston machine 1 according to the invention. By way of difference from the exemplary embodiment shown in FIGS. 1 to 3, a contact of the spring retainer 32 on the base of the pot-shaped housing part 3 is therefore not possible. Accordingly, a contact ring 46 is provided, which is disposed in contact with a rib formed in the interior of the pot-shaped housing part 3. The contact ring 46 once again provides a centring recess, in which the spring retainer 32 is arranged. The spring retainer 32 provides a central borehole, through which the actuating piston 11 or respectively 11' extends. The spring retainer 32 is slotted in a c-shape and, with the spring compressed, is pushed laterally onto the actuating piston 11 or respectively 11'. In this context, the spring retainer 32 is supported against the actuating piston.

Figure 5:
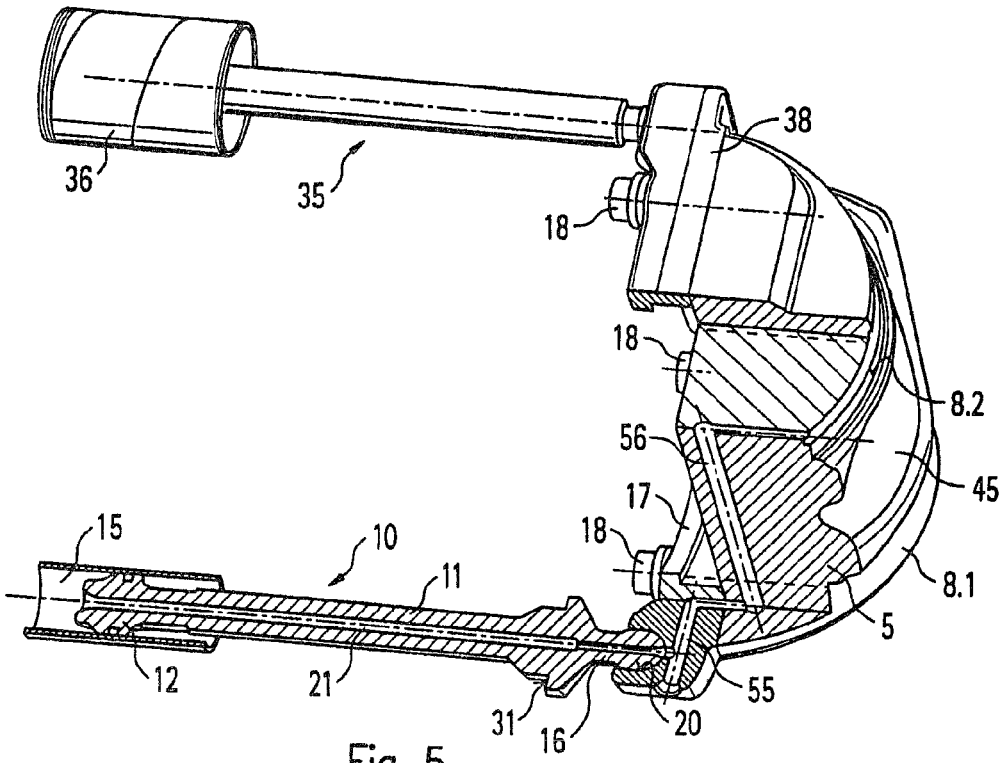
FIG. 5 shows a partial sectional presentation of an actuating system of the axial piston machine according to the invention by way of illustration of the channels provided in the swivel cradle for hydrostatic relief.

FIG. 5 shows a partial section through components of the actuating system of the axial piston machine 1 according to the invention. In this context, the course of the pressure channels within the first holding segment 17 and further in the swivel cradle 5 is illustrated in particular. It is clearly evident that the pressure channel opens in the swivel cradle 5 in the region of the second bearing surface 8.2 and therefore allows a hydrostatic relief of the swivel cradle 5.

The invention is not restricted to the exemplary embodiments presented. In particular, it is possible to combine individual features of the exemplary embodiment presented with one another in an advantageous manner.

The invention claimed is:

1. An axial piston machine comprising:

a swivel cradle, the inclination of which is capable of being modified in relation to a rotational axis of a cylinder drum, an actuating system acting on the swivel cradle, which comprises a first actuator for adjusting the inclination of the swivel cradle in a first displacement direction and a second actuator for adjusting the inclination of the swivel cradle in an opposite second displacement direction, wherein the first and the second actuator act on the swivel cradle on opposite sides in relation to the rotational axis, and a device for limiting the displacement of the swivel cradle, wherein the device for limiting the displacement of the swivel cradle comprises a first adjustable limiting device and a second adjustable limiting device, which each act on the swivel cradle and are located on opposite sides of the swivel cradle in relation to the rotational axis, wherein the regions in which the first and the second actuator are located and the regions in which the first and the second limiting device are disposed, differ from one another, wherein the swivel cradle comprises a running surface for supporting longitudinally displaceable pistons arranged within the cylinder drum, and the first and second actuators and the first and second adjustable limiting devices are disposed on the side of the swivel cradle comprising the running surface;

wherein the first and second adjustable limiting devices each comprise a setting screw, which is screwed into a thread in a housing borehole; and wherein at least one of the first and second actuators comprises an elastic element, which applies to the swivel cradle a force acting in the first displacement direction or in the second displacement direction.

2. The axial piston machine according to claim 1, wherein a swivel axis (S) of the swivel cradle and the rotational axis are disposed perpendicular to one another, and at least one of the first and second actuators is formed in a plane disposed parallel to the rotational axis and perpendicular to the swivel axis (S).

3. The axial piston machine according to claim 2, wherein the first actuator and the first adjustable limiting device limiting the displacement of the swivel cradle in the first direction are arranged in a first plane, of which the surface normal extends parallel to the swivel axis (S) of the swivel cradle and/or the second actuator and the second adjustable limiting device limiting the displacement of the swivel cradle in the second direction are arranged in a second plane, of which the surface normal extends parallel to the swivel axis (S) of the swivel cradle.

4. The axial piston machine according to claim 1, wherein at least one of the first actuator and the second actuator comprises an actuating piston.

5. The axial piston machine according to claim 4, wherein for the actuating piston, a blind borehole, in which the end of the actuating piston facing away from the swivel cradle is guided, is provided in a housing of the axial piston machine on the side opposite to the swivel cradle.

6. The axial piston machine according to claim 5, wherein the actuating piston comprises a crowned actuating-piston disc at an end of the piston that is arranged in the blind borehole.

7. The axial piston machine according to claim 4, wherein an end of the actuating piston, which transfers an actuating force to the swivel cradle, is connected to the swivel cradle in via a holding segment.

8. The axial piston machine according to claim 4, wherein for the connection of the actuating piston to the swivel cradle or to a holding segment, a spherical-headed connection, which is partially relieved in a hydrostatic, lubricated manner, is formed.

9. The axial piston machine according to claim 7, wherein the holding segment comprises a stopping surface to limit the displacement of the swivel cradle in the displacement direction specified by a respective actuator, which cooperates with the corresponding first or second adjustable limiting device.

10. The axial piston machine according to claim 9, wherein on the holding segment, a further stopping surface is formed, which cooperates with a counter element of a housing of the axial piston machine as a safety stop.

11. The axial piston machine according to claim 10, wherein the counter element is formed on a pot-shaped housing part or a flange part.

12. The axial piston machine according to claim 1, wherein the first actuator comprises a first actuating piston and the second actuator comprises a second actuating piston, wherein for each actuating piston, a blind borehole, in which the end of the first and second actuating pistons facing away from the swivel cradle is guided, is provided in a housing of the axial piston machine on the side opposite to the swivel cradle, and wherein a pressure-medium channel is formed in at least one of the first and second actuating pistons, which connects the blind borehole to the end of the at least one actuating piston facing towards the swivel cradle.

13. The axial piston machine according to claim 8, wherein channels are formed in the swivel cradle and/or in the holding segment, through which a pressure medium is supplied from the blind borehole to at least one bearing surface of the swivel cradle.

14. The axial piston machine according to claim 1, wherein starting from a neutral position, in which a surface normal of the running surface of the swivel cradle extends parallel to the rotational axis, the swivel cradle is capable of being swiveled in two opposite directions.

15. The axial piston machine according to claim 1, wherein the elastic element is a spiral spring surrounding an actuating piston of the first or second actuator, which is supported against a spring retainer of a housing of the axial piston machine.

16. The axial piston machine according to claim 15, wherein the spring retainer is in contact with a base of a pot-shaped housing part or is in contact with a contact ring at a spacing distance from the base of the pot-shaped housing part.

* * * * *